US007527158B2

(12) United States Patent
Gainer et al.

(10) Patent No.: US 7,527,158 B2
(45) Date of Patent: May 5, 2009

(54) DESK CADDY

(76) Inventors: Shannon Gainer, 134 S. Howell St., Hillsdale, MI (US) 49242; Kevin Gainer, 134 S. Howell St., Hillsdale, MI (US) 49242

( * ) Notice: Subject to any disclaimer, the term of this patent is extended or adjusted under 35 U.S.C. 154(b) by 261 days.

(21) Appl. No.: 11/365,171

(22) Filed: Mar. 1, 2006

(65) Prior Publication Data

US 2007/0205170 A1 Sep. 6, 2007

(51) Int. Cl.
*A47G 29/087* (2006.01)

(52) U.S. Cl. ..... 211/119.005; 211/88.01; 211/113

(58) Field of Classification Search ..... 211/90.01, 211/87.01, 119.005, 10, 11, 126.1, 113, 75, 211/74, 88.01, 86.01; D19/75, 78, 79; 108/25, 108/26, 26.2
See application file for complete search history.

(56) References Cited

U.S. PATENT DOCUMENTS

| | | | | | |
|---|---|---|---|---|---|
| 2,279,442 | A | | 4/1942 | Burns et al. | 249/311 |
| D162,153 | S | | 2/1951 | Gilfert | D74/21 |
| 3,904,041 | A | | 9/1975 | Medgebow | 211/72 |
| D251,229 | S | | 3/1979 | Wooters | D7/70 |
| D257,113 | S | * | 9/1980 | McCaffrey | D7/701 |
| 4,241,921 | A | * | 12/1980 | Miller | 273/148 A |
| 4,312,455 | A | * | 1/1982 | Weber | 211/119.005 |
| 4,700,829 | A | * | 10/1987 | Goodyear | 206/214 |
| 4,727,890 | A | * | 3/1988 | Vincent | 131/329 |
| 4,828,121 | A | * | 5/1989 | Willcocks, Jr. | 211/94.01 |
| D317,178 | S | * | 5/1991 | Kheng | D19/75 |
| D324,932 | S | * | 3/1992 | Zingaro et al. | D34/1 |
| D332,631 | S | * | 1/1993 | Klodt | D19/78 |
| 5,377,850 | A | * | 1/1995 | Liaw | 211/163 |
| D361,598 | S | * | 8/1995 | Adams | D19/77 |
| 5,458,394 | A | * | 10/1995 | Nichols et al. | 297/173 |
| 5,503,297 | A | * | 4/1996 | Frankel | 220/751 |
| D370,681 | S | * | 6/1996 | Diamond | D14/252 |
| 5,657,880 | A | * | 8/1997 | Birnbaum | 211/50 |
| D391,990 | S | * | 3/1998 | Wolff | D19/78 |
| 5,803,275 | A | * | 9/1998 | Schweitzer | 211/88.01 |
| 5,953,999 | A | * | 9/1999 | Kanehl | 108/44 |
| 5,971,171 | A | * | 10/1999 | Thorp et al. | 211/128.1 |
| D415,995 | S | * | 11/1999 | Kanehl, Jr. | D12/419 |
| D422,828 | S | * | 4/2000 | Kanfer et al. | D6/567 |
| 6,044,982 | A | * | 4/2000 | Stuart | 211/43 |
| 6,092,672 | A | * | 7/2000 | Harris et al. | 211/11 |
| 6,189,711 | B1 | * | 2/2001 | Chang | 211/163 |
| 6,290,063 | B1 | * | 9/2001 | Vogt et al. | 206/549 |
| D453,276 | S | * | 2/2002 | Stravitz | D6/571 |
| D456,452 | S | * | 4/2002 | Chang | D19/78 |
| 6,484,989 | B1 | * | 11/2002 | Connery | 248/311.2 |
| 6,968,957 | B2 | * | 11/2005 | Fynn | 211/11 |

(Continued)

*Primary Examiner*—Jennifer E. Novosad
(74) *Attorney, Agent, or Firm*—Young Basile

(57) ABSTRACT

A desk caddy intended for grade school children sitting at a desk having a storage bin. The caddy includes a box with integral front, back and opposite side walls and one or two internal dividers. One of the dividers, along with the front back and a side wall defines a water bottle compartment having raised ribs in the floor so that the bottle sits up off of the floor of the compartment. At least one hanger hook is integrated with the back wall so that the box may be hung on the edge of the storage bin. Alternatively, means are provided to slide the caddy onto the edge of a desk top. The unit is preferably made of injection molded plastic.

8 Claims, 3 Drawing Sheets

U.S. PATENT DOCUMENTS 7,043,778 B1 * 5/2006 Georgitsis et al. ..... 5/93.1
7,134,714 B1 * 11/2006 Connery ..... 297/153
D535,842 S * 1/2007 Wood ..... D6/567
D542,533 S * 5/2007 Yang ..... D3/313
2003/0042218 A1 * 3/2003 Bell ..... 211/88.01

* cited by examiner

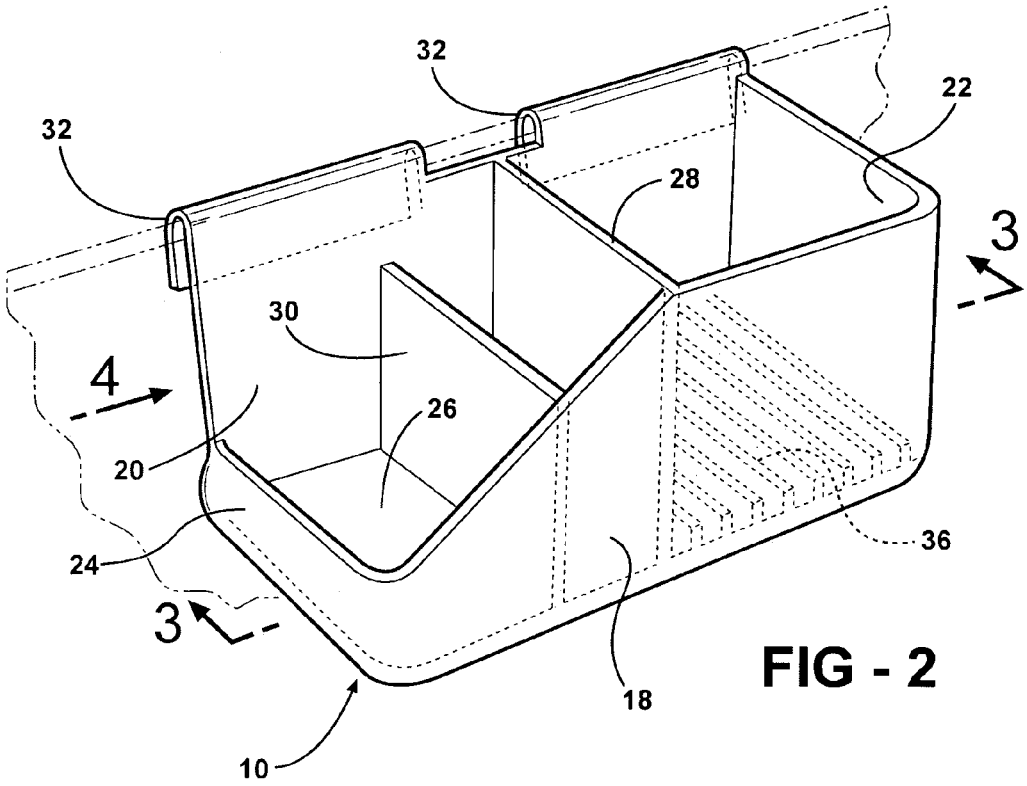
FIG - 2
FIG - 3
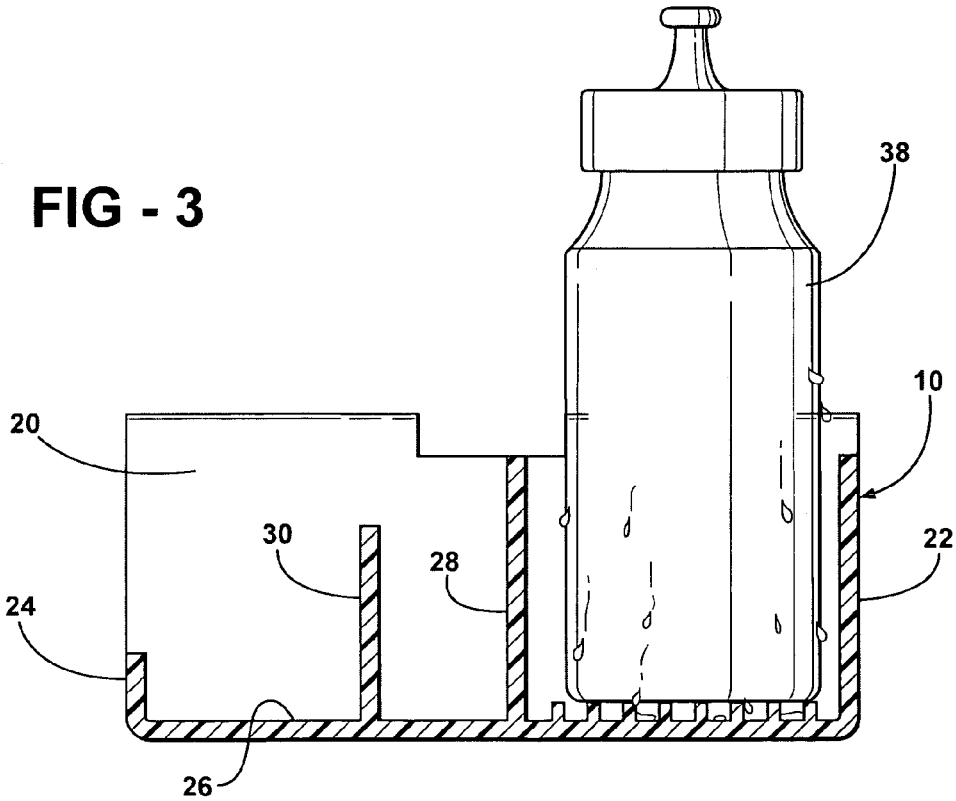

DESK CADDY

FIELD OF THE INVENTION

This invention relates to utility boxes and more particularly to a molded plastic desk caddy suitable for use in combination with a student desk to hold a water bottle and various other paraphernalia.

BACKGROUND OF THE INVENTION

It is common for students to "set up shop" at their desks not only with the usual pens, pencils, bookmarks, rulers and erasers, but also with a water bottle. Various attempts have been made to construct organizer boxes for pens, pencils, bookmarks erasers, and so forth. Similar attempts have been made to create holders for water bottles, but not with the needs of a student in mind; i.e.; most devices are sports related. To our knowledge, no one has designed or constructed a device which meets the objectives of holding student paraphernalia and a water bottle and does so in an aesthetically pleasing, as well as useful and economical fashion.

SUMMARY OF THE INVENTION

In accordance with our invention, we provide a desk caddy which can be attached to conventional student desk and is capable of holding not only the ordinary paraphernalia of school students, but also a water bottle. In accordance with that objective, our desk caddy comprises integral front, back and opposite side walls and a floor extending between the front, back and side walls to define a generally rectangular box. Within the box we utilize at least one and preferably two dividers which extend between the front and back walls parallel to and spaced from the side walls to define two or three compartments, one of which is sized and shaped to accommodate a water bottle. In addition, we locate a raised pattern such as a plurality of parallel spaced vertical ribs in the bottom of the water bottle compartment such that the water bottle sits on the pattern and is raised above the compartment floor. The pattern may take any of many forms.

In the preferred form of our invention we incorporate a structure which can be used to attach the desk caddy to a desk. In one form, the attachment structure comprises a hanger which is integral with the top edge of the back wall and extends downwardly from the top edge in parallel, spaced relationship with the back wall. With this structure, the caddy may be hung on the side of a storage bin which is underneath the desk top. In this embodiment, the back wall is bumped out toward the bottom portion so that the desk caddy, when hooked over the top edge of a desk storage bin, sits more or less vertically upright rather than tilted.

In another form, the attachment structure allows the caddy to be attached directly to the edge of the desk top itself.

In the illustrated embodiments, we incorporate an aesthetically pleasing and utilitarian slope to the front wall so that at least one of the compartments is lower than the compartment holding the water bottle, thus facilitating access to smaller implements such as erasers and bookmarks. The entire box is preferably integrally made of injection molded plastic so as to be both useful and economical to manufacture.

BRIEF DESCRIPTION OF THE DRAWINGS

FIG. 2 is a perspective view of the embodiment of FIG. 1 showing interior details;

FIG. 3 is a sectional view of the device of FIG. 2 along with section line 3-3;

DETAILED DESCRIPTION OF THE ILLUSTRATIVE EMBODIMENTS

Figure 1:
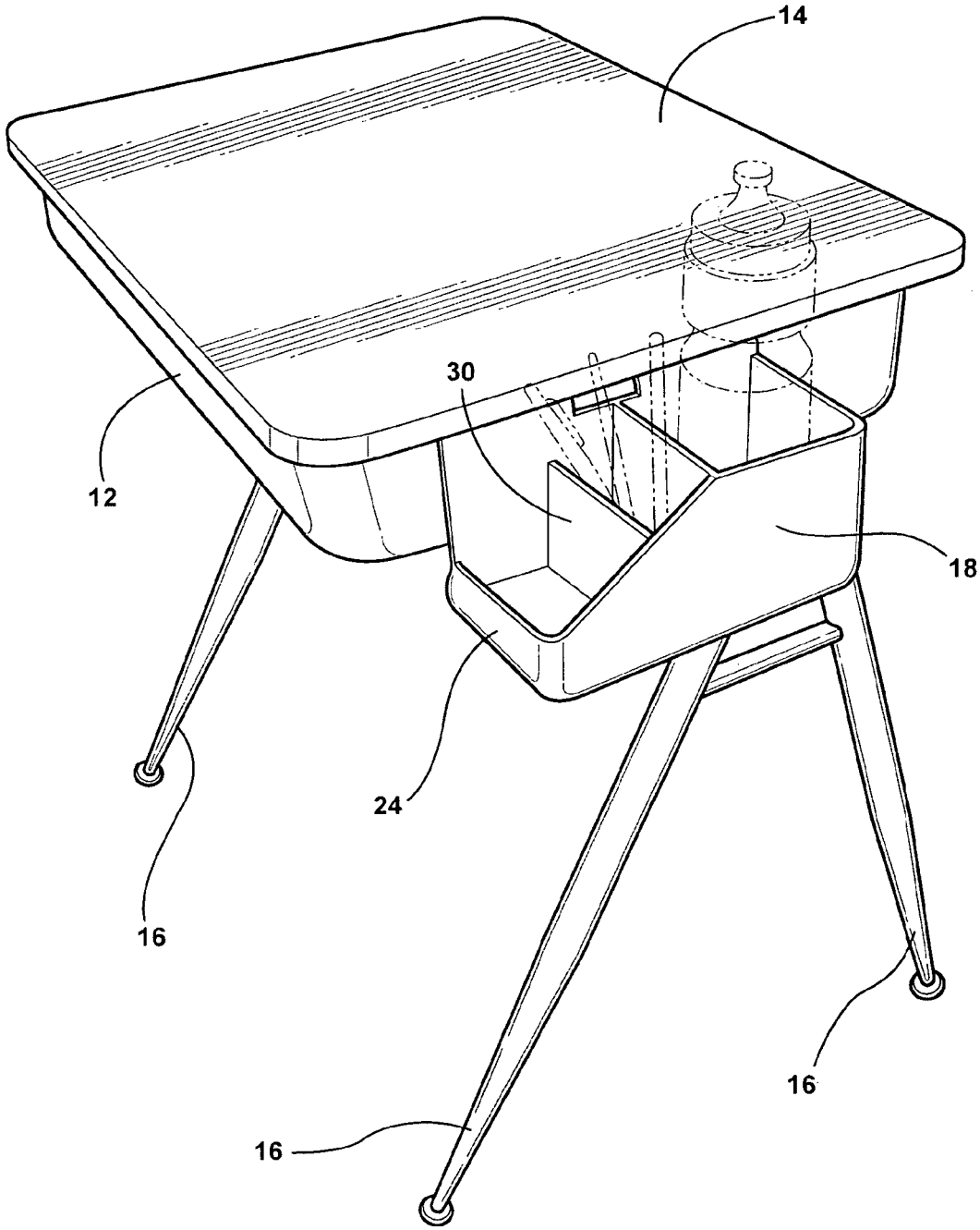
FIG. 1 is a perspective view of a first illustrative embodiment of the invention attached to a conventional student desk.

Referring to the drawing there is shown a molded plastic desk caddy 10 attached to the side of a storage bin 12 which underlies the hinged top 14 of a conventional student desk having metal legs 16. The desk caddy 10 is of integral molded plastic construction and comprises a front wall 18, a rear wall 20, opposite parallel side walls 22 and 24 extending between the front and back walls 18, 20, and a floor 26. In addition, spaced parallel dividers 28 and 30 run fore and aft between the front wall 18 and the rear wall 20 and are integral therewith. The left portion of the front wall 18 as shown in FIG. 2 is sloped and the divider 30 is shorter than the divider 28. Similarly, side wall 24 is shorter than sidewall 22 so as to facilitate access to the contents of the storage compartment defined by the space between the side wall 24 and the divider 30. That storage compartment lies closest to the student when the desk caddy 10 is mounted on the right side of a desk as shown in FIGS. 1, 2 and 4.

Figure 4:
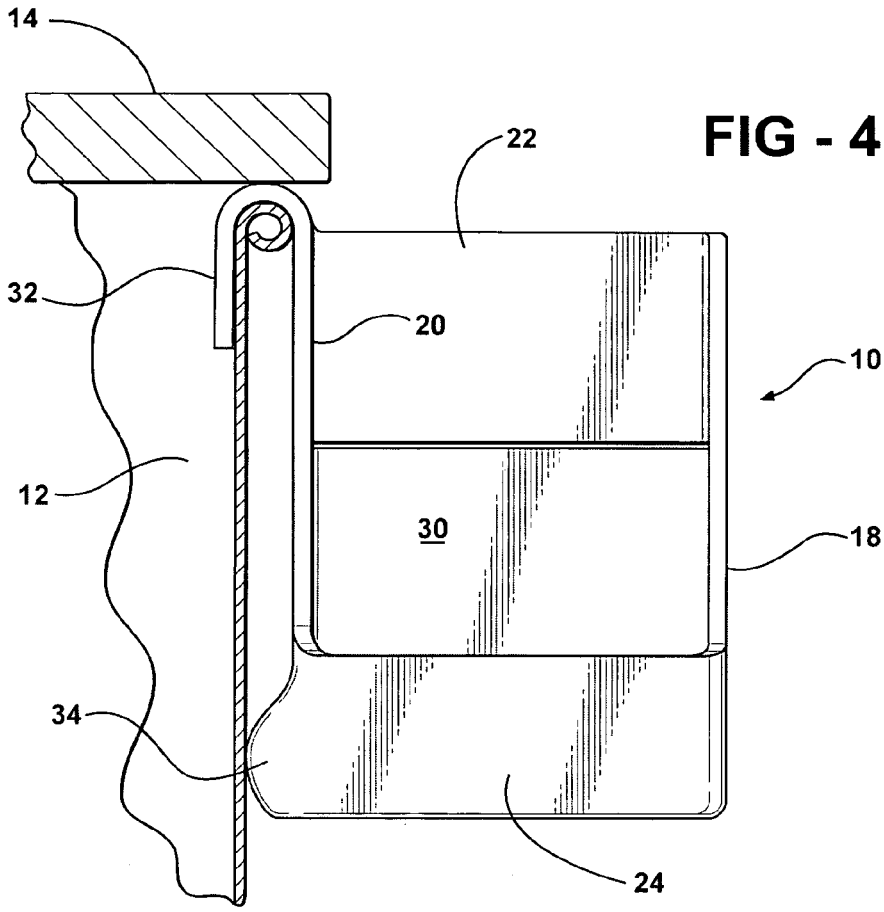
FIG. 4 is a side view of the device of FIG. 1 showing how it is attached to the storage bin and the student desk.

A pair of hangers or hooks 32 are formed integral with and extending downwardly from the top of the rear wall 20 in spaced relationship with the main portion of the rear wall 20 to permit the caddy 10 to be hung over the top edge of the metal (or plastic) storage bin 12 which is part of the conventional student desk as best shown in FIG. 4. The use of two spaced hooks 32 is merely illustrative as a single continuous hook as well as three or more separate parallel hooks may also be used. The use of multiple smaller hooks reduces the amount of plastic needed to manufacture the caddy 10.

As shown in FIG. 4 the lower rear wall portion 34 is bumped out to accommodate the space between the rear wall 20 and the side of the storage bin 12 so that the caddy 10 hangs essentially upright rather than tilted or angled. The bumped out lower back portion 34 can be achieved integrally by thickening the rear back wall portion or by adding a strip of plastic or other material to the caddy 10 after it has been injection molded.

The tallest compartment; i.e., the compartment defined by the side wall 22 and the divider 28 is sized to accommodate a water bottle 38 and is further provided with spaced parallel ribs 36 in the floor 26 of that compartment so as to raise the bottom of the bottle 38 up off of the floor. This provides an area for the collection of water which may condense on the side of the bottle 38 if the contents thereof are chilled and used in a room with high humidity. The parallel pattern of ribs 36 is merely illustrative of various raised patterns which can be used.

In use, the top 14 of the student desk is raised by means of hinges (not shown) and the caddy 10 is hung on the side of the storage bin 12 as shown. The desktop 14 is then lowered and the caddy 10 remains in place as long as the student occupies the desk. It is a simple matter for the student to disengage the caddy 10 from the desk and place it in a backpack or locker or other storage facility when the school day is over.

Figure 5:
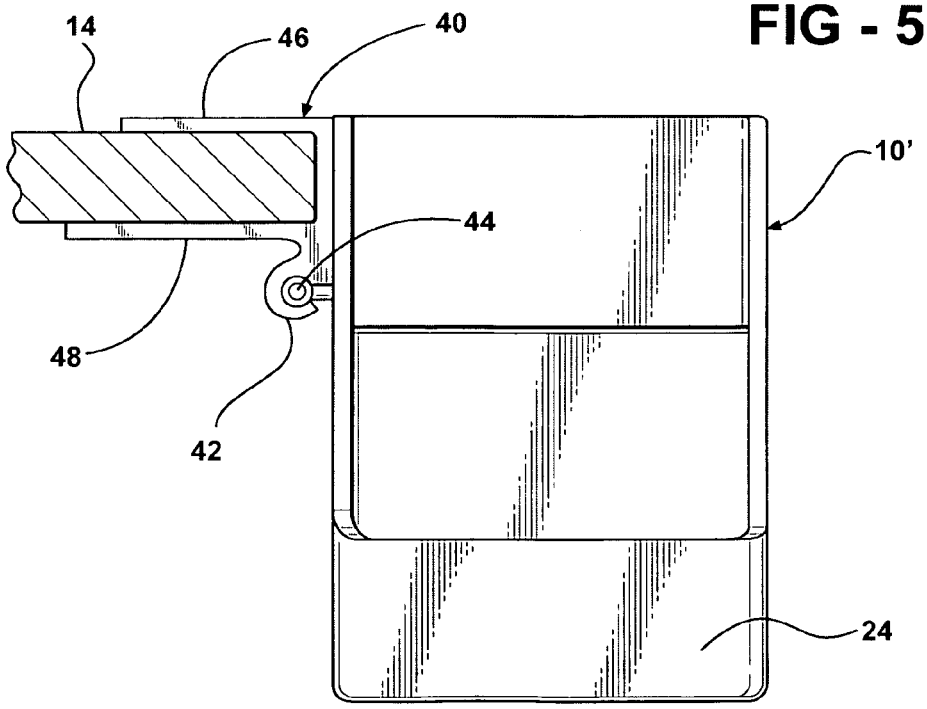
FIG. 5 is a side view of a second illustrative embodiment of the invention.

Referring to FIG. 5, a second embodiment includes a caddy 10' substantially identical to the caddy 10 of FIGS. 1-4 but with an attachment structure 40 adapted to mount caddy 10' on the edge of the desk top 14. Structure 40 includes parallel top and bottom flanges 46 and 48 attached to a beaded projection 44 on the back of the caddy 10' by way of a hinge 42. The flanges 46 and 48 are spaced apart by the thickness of the desk top 14 and simply slide onto the desktop 14 as shown. The hinge 42 and 44 allows the structure 40 to fold down or be removed entirely.

As indicated in several places above, the embodiment of the invention described herein is illustrative rather than limiting and various modifications and additions thereto may occur to persons skilled in the art. Medium or high density polyethylene is a good choice for the injection molding of the caddy 10, but other plastics such as polyurethane and/or the more expensive elastomeric plastics can also be used. Color is a matter of choice and a place may be provided to receive a sticker or label with the student's name if desired.

What is claimed is:

1. A student's desk caddy comprising:

integral front, back and opposite side walls and a floor extending fully between said front, back and opposite side walls to define a rectangular box with an open top, the front and back walls extending fully between the side walls, and the side walls extending fully between the front and back walls;

the back wall having a top edge and a bottom edge parallel to the top edge such that the distance between the top and bottom edges is constant along their lengths;

a plurality of fixed dividers extending between the front and back walls parallel to and spaced at different distances from one sidewall to define a plurality of compartments within the box; each of said front, back and sidewalls having a top edge;

the front wall top edge being sloped downwardly from the divider closest to said one sidewall toward the other side wall such that all of the compartments have different depths, with one of the compartments being a deepest compartment, the back wall being substantially rectangular such that its top edge is non-sloped;

said front and back walls being nonsymmetrical and said deepest compartment being defined by and between a portion of the back wall, a first of said sidewalls, and a portion of said front wall such that the top edges of the back wall portion, the first sidewall and the front wall portion are collinear and the depth of the deepest compartment is constant around its top edges;

a pattern of raised elements extending over the floor only in the deepest compartment such that a bottle or similar object placed in said compartment is in spaced relationship to said floor; and means for attaching the back wall of the caddy to a desk;

said attaching means comprising a hanger integral with the back wall at the top edge thereof.

2. A desk caddy as defined in claim 1 wherein the back wall is non-planar and defines a bumped out portion toward its bottom, the bumped out portion terminating prior to the top edge of the back wall and the at least one hanger terminating above the bumped out portion.

3. A desk caddy as defined in claim 1 wherein the attaching means comprises a pair of spaced apart flanges attached to the back wall and adapted to slide onto an edge of a desk top.

4. A desk caddy as defined in claim 3 wherein the attaching means is attached to the back wall by a hinge.

5. A desk caddy as defined in claim 1 wherein the caddy is made of plastic.

6. A student desk accessory designed for temporary attachment to a desk comprising:

a generally rectangular plastic box having a planar floor (24), a first rectangular wall (20) having a top edge and a bottom edge wherein said top and bottom edges are parallel to each other and parallel to the floor such that the distance between the top and bottom edges is uniform along their lengths, a second wall (18) opposite and parallel to the first wall (20) having a first portion of generally the same height as the first wall (20) and a second portion which slopes downwardly to a lower height, a third wall (22) between the first and second walls and of substantially the same height as the first and second walls, and a fourth wall (24) between and first and second walls and opposite the third wall (22); the second wall (18) and the first wall (20) being nonsymmetrical;

at least one divider extending between and attached to the first and second walls to define, on one side a deep compartment and, on the other side, a shallower compartment; said deep compartment being defined by a portion of the first wall (20), the third wall (22) and a portion of the second wall (18) such that the depth of said deep compartment is constant measured relative to its top edges;

raised ridges (36) formed on and integral with the floor (26) in the deep compartment; and attachment means attached to the box along the top edge of the first wall for temporary sliding attachment to the edge of a planar desk element.

7. The accessory of claim 6 wherein the attachment means comprises at least one rolled-over hanger (32) spaced from and integral with the first wall (20) and adapted to slide over the top edge of a vertical desk structure.

8. A student desk accessory designed for temporary attachment to a desk comprising:

a generally rectangular plastic box having a planar floor (24), a first rectangular wall (20) having a top edge and a bottom edge wherein said top and bottom edges are parallel to each other and parallel to the floor such that the distance between the ton and bottom edges is uniform along their lengths, a second wall (18) opposite and parallel to the first wall (20) having a first portion of generally the same height as the first wall (20) and a second portion which slopes downwardly to a lower height, a third wall (22) between the first and second walls and of substantially the same height as the first and second walls, and a fourth wall (24) between and first and second walls and opposite the third wall (22); the second wall (18) and the first wall (20) being nonsymmetrical;

at least one divider extending between and attached to the first and second walls to define, on one side a deep compartment and, on the other side, a shallower compartment; said deep compartment being defined by a portion of the first wall (20), the third wall (22) and a portion of the second wall (18) such that the depth of said deep compartment is constant measured relative to its top edges; and attachment means attached to the box- along the top edge of the first wall for temporary sliding attachment to the edge of a planar desk element.

* * * * *